United States Patent [19]

Dobry

[11] Patent Number: 4,818,044

[45] Date of Patent: Apr. 4, 1989

[54] LOCKER AND LOCKER-SHELF INSERT

[76] Inventor: Bradley M. Dobry, 20 Sheafe St., Apt. #6, Boston, Mass. 02113

[21] Appl. No.: 129,664

[22] Filed: Dec. 7, 1987

[51] Int. Cl.[4] ..... A47B 41/04

[52] U.S. Cl. ..... 312/257 SM; 108/29; 211/105.3

[58] Field of Search ..... 312/245, 257 SM; 108/29, 50; 211/105.3, 105.5, 105.6, 105.1, 189, 187, 87

[56] References Cited

U.S. PATENT DOCUMENTS

| | | | |
|---|---|---|---|
| 1,537,242 | 5/1925 | Lukins | 211/105.3 X |
| 2,615,770 | 10/1952 | Curtis | 211/189 |
| 2,991,040 | 7/1961 | Levy | 211/105.6 X |
| 3,088,422 | 5/1963 | Kaeslin | 108/29 |
| 3,259,082 | 7/1966 | Williams | 108/92 |
| 3,478,891 | 11/1969 | Kaestin | 108/29 |
| 4,126,231 | 11/1978 | Derwert-Wryde | 108/29 X |
| 4,209,099 | 6/1980 | Wickes | 211/105.3 X |
| 4,256,043 | 3/1981 | Ovitz | 108/29 |
| 4,324,076 | 4/1982 | Honickman | 108/29 X |
| 4,500,146 | 2/1985 | Peterson | 312/257 SM |

*Primary Examiner*—Joseph Falk

*Attorney, Agent, or Firm*—Andrew F. Kehoe

[57] ABSTRACT

Space and shelving problems in dressing room lockers are alleviated by provision of a locker insert having a shelf-bearing support structure and novel shelves affixed to the support structure and extending laterally across a portion of the width of said locker. The support structure comprises vertical support means adapted to fit close to on locker wall and a lateral rod support member extending horizontally above, and laterally beyond, said shelves. The horizontal support bears against an opposite locker wall and forms a clothes-hanging rod.

9 Claims, 2 Drawing Sheets

LOCKER AND LOCKER-SHELF INSERT

BACKGROUND OF THE INVENTION

Lockers of the type used in clubhouses, gymnasiums have poor aeration, tend to require bunching or crowding of clothes left therein. Other problems associated with lockers of the type commonly available is poor use of the available locker space.

Thus, there has remained a need for improved locker space utilization and the inventor has directed his efforts to providing a way to achieve such utilization.

SUMMARY OF THE INVENTION

It is an object of the invention to provide a new locker structure featuring a removable shelf structure.

It is an object of the invention to provide a new shelf structure for utilization in combination with a locker.

It is a further object of the invention to provide the aforesaid structure which have improved utility.

A more particular object of the invention is to provide a locker insert structure which can be readily converted, or assembled, in a left-hand or right-hand configuration.

Another object of the invention is to provide such structures which facilitate hanging of clothes therein.

Another object of the invention is to provide a removable locker insert which does not preempt use of any substantial amount of locker surface for its support.

Other objects of the invention will be obvious to those skilled in the art on their reading of this Application.

The above objects have been substantially achieved by the modification of a conventional locker by use of an insert, preferably removable, as more fully described below. The insert has the advantage of being a support for at least one, but usually a plurality, of supplemental shelves.

These shelves are mounted on a shelf-bearing support member which, preferably, has vertical support means immediately proximate one wall of the locker so they do not interfere with use of the floor on which the insert is supported. These vertical support means are all that is needed when a horizontal support means is immobilized against a side wall of the locker.

Thus, the invention relates both to a novel locker insert and the locker which is transformed into a novel locker construction by use of such an insert.

In general, the locker comprises a conventional locker housing. The insert consists of a first shelf-bearing support means, e.g. two legs, positioned on one side of the insert so that it will be out of the way immediately along one sidewall of the locker. Another insert support structure is a second rod forming, generally, a right angle. The second rod extends upwardly from its connection to the shelves, advantageously on the opposite side of the shelves from the first support means and then laterally, wherein it becomes suitable for use in hanging clothes in that portion of the width of the locker not occupied by the aforesaid shelving.

The second rod is advantageously immobilized from lateral movement by bearing against, or being held in position by mechanical means affixed to the wall against which it is supported.

Alternately, but less advantageously, the second support means rod (or its equivalent) can extend downwardly as an additional vertical support means rather than leaving the first support means as the only vertical support means.

In a preferred embodiment, the rod forming the second support means is made extensible to bear against the sidewall even when lockers are of different widths. Also, or alternatively, mechanical means can be used to immobilize the rod forming the second support means.

In the apparatus, it is especially desirable to round off the front corners of the shelves (adjacent the clothes hanging rod) to facilitate nuisance-free use of the clothes-hanging rod.

It is noted that the shelving will, in normal use, tend to promote less piling up of clothes in one spot and thereby improve ventilation. However, fenestrated shelving would improve this feature of the invention somewhat.

ILLUSTRATIVE EMBODIMENT OF THE INVENTION

In this application there is described a preferred embodiment of the invention and suggested various alternatives and modifications thereof, but it is to be understood that these are not intended to be exhaustive and that other changes and modifications can be made within the scope of the invention. These suggestions herein are selected and included for the purposes of illustration in order that others skilled in the art will more fully understand the invention and the principles thereof and will be able to modify it and embody it in a variety of forms, each as may be best suited to the condition of a particular case.

The following example relates to a specific embodiment of the invention wherein the locker dimensions are 36 inches in height, 16 inches in depth and 12 inches in width. It will be clear that the invention can be adapted to lockers of various sizes.

Figure 1:
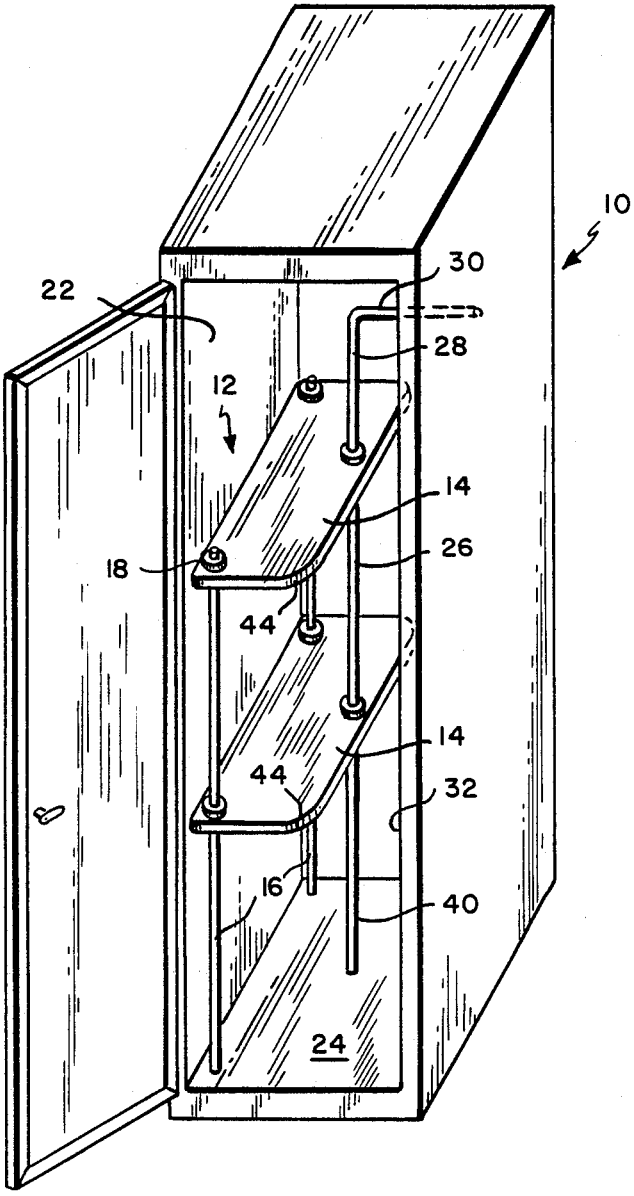
FIG. 1 is a perspective view of a locker structure according to the invention comprising a novel locker insert structure, also claimed herein.
Figure 3:
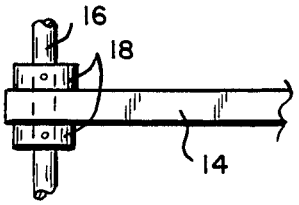
FIG. 3 shows a means to obtain adjustment of the vertical position of shelf units of the invention.
Figure 4:
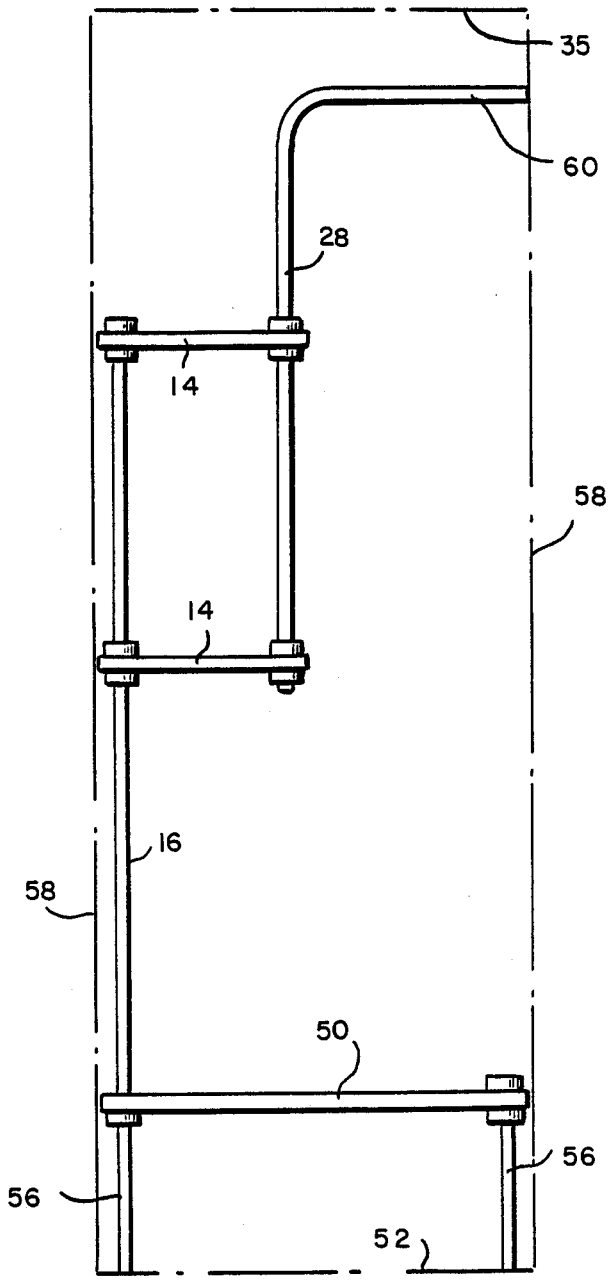
FIG. 4 illustrates an embodiment of the invention utilizing a fully-supported lower shelf.

Referring to FIG. 1, it is seen that a locker housing 10 comprises a locker insert assembly 12 snugly inserted into the housing 10. Insert assembly 12 comprises a plurality of shelves 14 constructed of wood, plastic (or of a perforated or screen structure). The shelves 14 are vertically adjustable on support legs 16 by means of locknuts 18 (see FIG. 3) that themselves are slideable along the shaft and held by nuts 18 through which locking screws 20 hold against rods 16.

Legs 16 are placed immediately adjacent wall 22 so they do not substantially interfere with the utility of the locker floor 24, i.e., a horizontal support. A third support, a lateral support means 26 comprises a vertical component 28 and a lateral component 30. The lateral support rod is preferably fixed in position, i.e. by forcibly bearing against vertical wall 32. This bearing (or mere insertion in a hole or well 36 in wall 32) or many other means known to the art, is required if one wishes to stabilize the insert 12 against movement.

Figure 2:
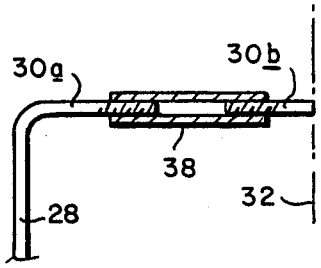
FIG. 2 shows a lateral adjustment useful in the process of the invention.

One suitable means for tensing is shown in FIG. 2 wherein the lateral portion 30 of rod 26 is divided into two parts 30*a* and 30*b*. Each part 30*a* and 30*b* has a threaded end which threads into internally threaded coupling 38 and allows the insert 12 to be used to make lateral rod 30 extensible and tighten it against the vertical wall 32 after insertion into the locker.

It should be noted that leg 40, a lower extension of support rod 26, is not necessary when the rod 26 is held in place against vertical wall 32 and is shown in FIG. 1 as an alternative to bracing support 28 against a sidewall of the locker.

It should be noted that rod 30 comprises a means from which clothes, e.g. on hangers, can be suspended.

It has been found most convenient to round off the corners of the shelves 14 as seen at 44 to avoid snagging clothing being hung, particularly when the shelves take up more than, or close to, about 50% of the locker width as they do in the illustrative embodiment. In a preferred embodiment of the invention, the shelves take up from 40 to 80% of the width and, most conveniently, 60–75% of the width.

An alternative to the illustrated embodiment is the use of a lower shelf 50 that covers all or most of the bottom 52 of the locker and is, preferably, at least high enough, say four to six inches, to store such items as shoes, etc. The support structure, e.g. legs (56), would be immediately adjacent the locker walls 58. In such a case, the lateral rod 60 would not need to act as a support means.

It is also to be understood that the following claims are intended to cover all of the generic and specific features of the invention herein described and all statements of the scope of the invention which might be said to fall therebetween.

What is claimed is:

1. A locker construction comprising a locker housing having a pair of spaced-apart lateral walls, a floor, and a readily-removable insert therein, said insert consisting of (a) a shelf-bearing support structure;

(b) shelves affixed to said structure and extending laterally across a first portion of the width of said locker;

(c) said support structure comprising (1) a vertical support means bearing against a horizontal support surface of said locker and positioned immediately proximate to a first lateral wall of said locker and (2) a lateral support member for said insert comprising a first length connected to said shelves or said support structure and extending upwardly from the uppermost of said shelves and a second length extending horizontally and laterally across a second portion of the width of said locker, said second length being immobilized against a second lateral locker wall and forming means to maintain said insert in an upright position.

2. A locker construction as defined in claim 1 wherein said lateral rod is extensible to provide means to adapt to lockers of different widths.

3. A locker construction as defined in claim 1 wherein said first support means is the only vertical support means for said apparatus.

4. A locker construction as defined in claim 1 wherein said shelves are rounded away at a front corner of said shelves on the side of said shelves adjacent to said rod.

5. A locker construction as defined in claim 1 wherein second locker wall comprises mechanical means to accept the end of said rod and resist any movement thereof.

6. A locker insert comprising (a) a shelf-bearing support structure;

(b) at least one shelf affixed to said structure and extending laterally for about one-half of the total width of the insert;

(c) said support structure comprising (1) a first support means at one side of said insert adapted to be positioned on a floor of a locker immediately adjacent a first opposed lateral sidewall of a locker and (2) a lateral rod support member connected to said shelf extending vertically above and laterally beyond said shelf and adapted to bear against a second opposed lateral sidewall of each locker, thereby forming means to support said insert in an upright position.

7. A locker insert as defined in claim 6 wherein said lateral rod comprises rod-extending means to adapt its length to lockers of different widths.

8. A locker insert as defined in claim 6 wherein said first support means is the only vertical support means for said apparatus.

9. A locker insert as defined in claim 6 wherein said shelves are rounded away at a front corner of said shelves on the side of said shelves adjacent to said rod.

* * * * *